US012330847B1

(12) United States Patent
Wulf

(10) Patent No.: US 12,330,847 B1
(45) Date of Patent: Jun. 17, 2025

(54) STORAGE CONTAINER WITH STORABLE LID

(71) Applicant: Cassandra Wulf, Chesterfield, MO (US)

(72) Inventor: Cassandra Wulf, Chesterfield, MO (US)

(73) Assignee: Cassandra Wulf, Chesterfield, MO (US)

( * ) Notice: Subject to any disclaimer, the term of this patent is extended or adjusted under 35 U.S.C. 154(b) by 62 days.

(21) Appl. No.: 18/114,331

(22) Filed: Feb. 27, 2023

Related U.S. Application Data

(60) Provisional application No. 63/315,697, filed on Mar. 2, 2022.

(51) Int. Cl.
*B65D 55/16* (2006.01)
*B65D 1/24* (2006.01)

(52) U.S. Cl.
CPC ..... *B65D 55/16* (2013.01); *B65D 1/24* (2013.01)

(58) Field of Classification Search
CPC ..... B65D 1/24; B65D 1/246; B65D 55/16; B65D 21/0233; B65D 2543/00379; A47J 36/027; A47J 47/02; A47J 47/08
USPC ..... 220/379, 503, 744, 23.83; 206/514
See application file for complete search history.

(56) References Cited

U.S. PATENT DOCUMENTS

| | | | | |
|---|---|---|---|---|
| 4,040,538 | A * | 8/1977 | Gerson | A47G 19/14 220/500 |
| 7,357,273 | B1 * | 4/2008 | Lutz | A47J 36/027 220/636 |
| 2007/0017921 | A1 * | 1/2007 | Carmona | B65D 21/086 220/666 |
| 2007/0131701 | A1 * | 6/2007 | Herbert | B65D 21/0233 220/826 |

* cited by examiner

*Primary Examiner* — Nathan J Jenness
*Assistant Examiner* — Madison L Poos
(74) *Attorney, Agent, or Firm* — Glen E. Schumann; Moss & Barnett

(57) ABSTRACT

A storage container system that includes a lid and a storage container. The lid is positionable in a folded configuration and an unfolded configuration. The storage container includes an opening and a lid storage region. When the lid is in the unfolded configuration, the lid is attachable to the storage container to substantially enclose the opening. The lid storage region is on an outer surface of the storage container. When the lid is in the folded configuration, the lid is positionable at least partially in the lid storage region.

4 Claims, 10 Drawing Sheets

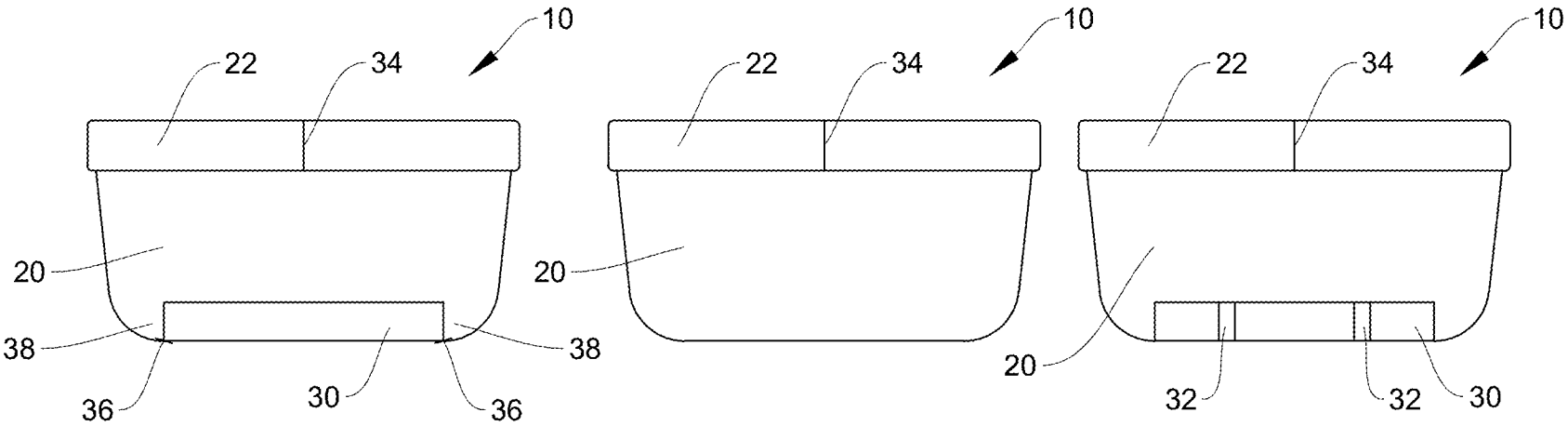
FIG. 1A
FIG. 1B
FIG. 1C
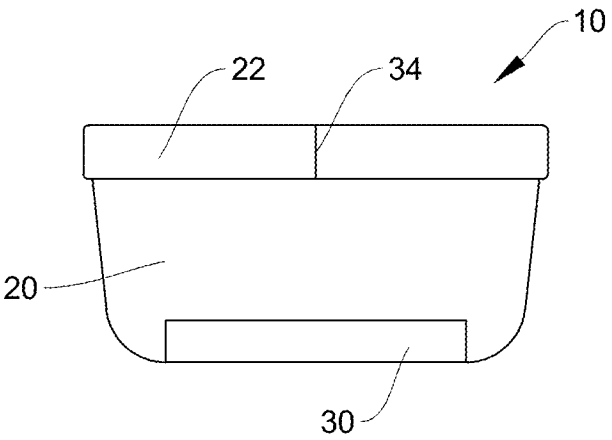
FIG. 1D

STORAGE CONTAINER WITH STORABLE LID

REFERENCE TO RELATED APPLICATION

This application claims priority to Provisional Applic. No. 63/315,697, filed on Mar. 2, 2023, the contents of which are incorporated herein by reference.

FIELD OF THE INVENTION

The invention relates generally to storage containers. More particularly, the invention relates to storage containers with storable lids.

SUMMARY OF THE INVENTION

An embodiment of the invention is directed to storage container system that includes a lid and a storage container. The lid is positionable in a folded configuration and an unfolded configuration. The storage container includes an opening and a lid storage region. When the lid is in the unfolded configuration, the lid is attachable to the storage container to substantially enclose the opening. The lid storage region is on an outer surface of the storage container. When the lid is in the folded configuration, the lid is positionable at least partially in the lid storage region.

Another embodiment of the invention is directed to a storage container system that includes a lid and a storage container. The lid has a first lid section and a second lid section that are joined together along a fold line. The lid is positionable in a folded configuration and an unfolded configuration. When the lid is in the folded configuration, the first lid section is adjacent to the second lid section. When the lid is in the unfolded configuration, the first lid section is in a planar orientation with respect to the second lid section. The storage container includes an opening and a lid storage region. The lid storage region is positioned proximate a lower surface of the storage container. When the lid is in the unfolded configuration, the lid is attachable to the storage container to substantially enclose the opening. The lid storage region is on an outer surface of the storage container. When the lid is in the folded configuration, the lid is substantially in the lid storage region.

Another embodiment of the invention is directed to a method of using a storage container system. A lid is provided that includes a first lid section and a second lid section that are joined together along a fold line. A storage container is provided that includes an opening and a lid storage region. The lid storage region is positioned proximate a lower surface of the storage container. The lid is positioned in an unfolded configuration and attached the lid to the storage container to substantially enclose the opening. The lid is positioned in a folded configuration and stored the lid in the lid storage region.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIG. 1*a* is a back view of the storage container with an open lid storage region.

FIG. 1*b* is a back view of the storage container with a solid lid storage region.

FIG. 1*c* is a back view of the storage container with a storage region having supports.

FIG. 1*d* is a front view of the storage container.

DETAILED DESCRIPTION OF THE INVENTION

Figure 2B:
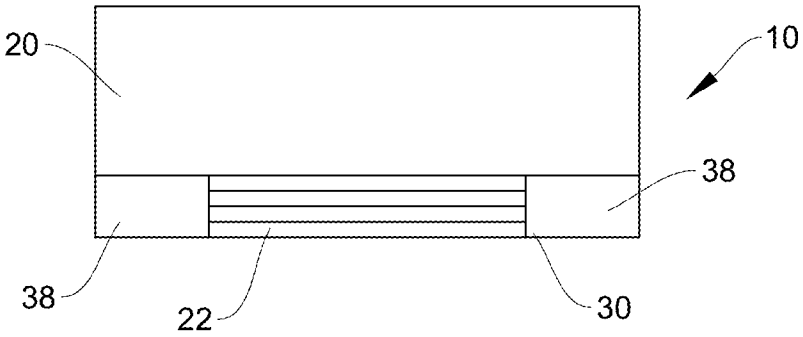
FIG. 2*b* is a front view of the lid stored in the storage container.

An embodiment of the invention is directed to a storage container system, which is illustrated as 10 in the drawings. The storage container system 10 generally includes a storage container 20 and a lid 22.

The storage container system 10 enables objects to be securely stored in an opening 24 in the storage container 20 when the lid 22 is attached to the storage container 20. The storage container 20 has a lid storage region 30 provided on an outer surface thereof that enables the lid 22 when positioned in a folded configuration to be stored therein. The storage container system 10 thereby minimizes the potential of one of the storage container 20 and the lid 22 becoming misplaced.

The storage container 20 may have a variety of shapes and sizes using the concepts of the invention. In one such embodiment, the storage container 20 is defined by four side walls and a bottom wall that together define the partially enclosed region. For example, while the storage container 20 is illustrated as having a generally square shape, the storage container 20 may be fabricated with different shapes, examples of which include rectangular, circular and oval.

In certain embodiments, the bottom wall of the storage container 20 may serve as the upper wall of the lid storage region 30. The lid storage region 30 includes a drawer-type configuration with an opening along a side of the storage container 20. Inserting the lid 22 from the side enables the lid 22 to be retained in the lid storage region 30 when the storage container 20 is lifted. The lid storage region 30 has a width that is equal to or larger than the width of the lid 22.

FIGS. 1*a*-1*c* illustrate different configuration of the lid storage region 30. In each of the configurations illustrated in FIGS. 1*a*-1*c*, the front view of the storage container 20 is as illustrated in FIG. 1*d*.

FIG. 1*a* illustrates the lid storage region 30 having an open lower surface. The lid storage region 30 is defined by extensions 38 that extend from the lower surface of the storage container 20. The extensions 38 are spaced apart from each other at a distance that is approximately equal to the width of the lid 22 when in the folded configuration. The extensions 38 support the storage container 20 so that when the storage container 20 is placed on a surface, the weight of the storage container 20 and objects stored therein is not on the lid 22. This configuration thereby protects the lid 22 from damage.

As illustrated in FIG. 1*a*, flanges 36 inwardly extend from the extensions 38. The flanges 36 define a space therebetween that is smaller than the width of the lid 22 when in the folded configuration. The flanges 36 thereby prevent the lid 22 from falling out of the lid storage region 30. An advantage of this configuration is that since the lower surface of the lid storage region 30 is open, this configuration enhances the ability to clean the lid storage region 30.

In another embodiment, the flanges 36 could flex, allowing one edge of the lid 22 to be mounted above one side flange 36 and the opposite edge of the folded lid 22 to be snapped into place above the opposite side flange 36. In another embodiment, a tab or flap extends down-ward from the bottom of the storage container 20 between opposite side extensions 38 to help prevent the lid 22 from sliding off the flanges 36.

FIG. 1*b* illustrates the lid storage region 30 having a full bottom panel that extends between opposite sides of the storage container 20. An advantage of this configuration is that the strength of the storage container 20 is enhanced. In this embodiment, there are no ridges or edges within the storage space so that cleaning the interior of the storage container 20 is easier.

FIG. 1*c* illustrates two elongated supports 32 extending along the lower surface of the lid storage region 30. While this configuration is not as easy to clean as the configuration illustrated in FIG. 1*a*, this configuration provides the storage container 20 with enhanced strength as compared to the configuration illustrated in FIG. 1*a*.

The lid 22 is capable of forming a secure seal with the storage container 20 so that when the lid 22 is attached to the storage container 20, the lid 22 resists separation from the storage container 20. A person of skill in the art will appreciate that the lid 22 and the storage container 20 may have a variety of configurations to achieve this result. For example, the lid 22 may have a lower ridge that fits within the opening 24 of the storage container 20.

The lid 22 has a fold line 34 that extends from opposite edges thereof that defines a first lid section 22*a* and a second lid section 22*b*. In certain embodiments, the first lid section 22*a* has a shape and a size that are substantially the same as a shape and a size of the second lid section 22*b*. The concepts of the invention may be utilized when the fold line 34 is oriented longitudinally or transversely.

Figure 3:
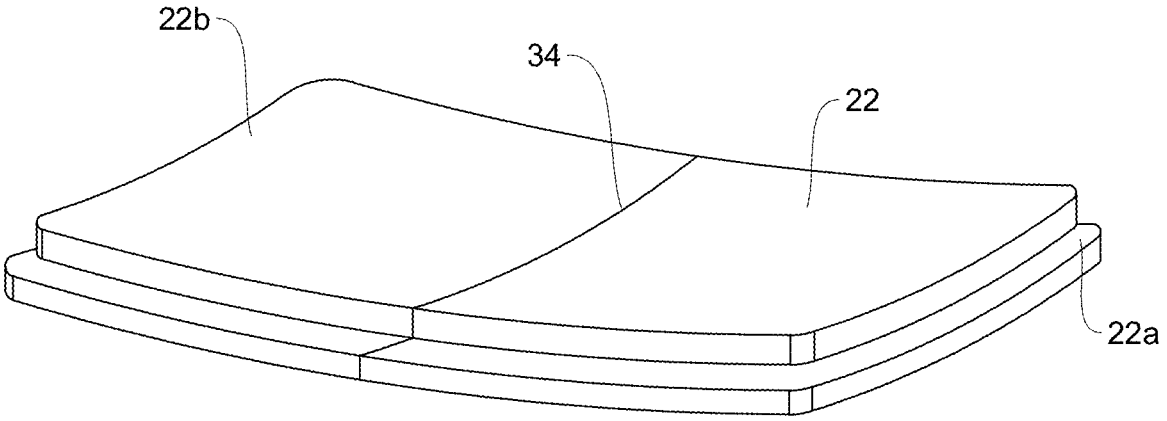
FIG. 3 is a side view of the lid in a flat configuration.
Figure 4:
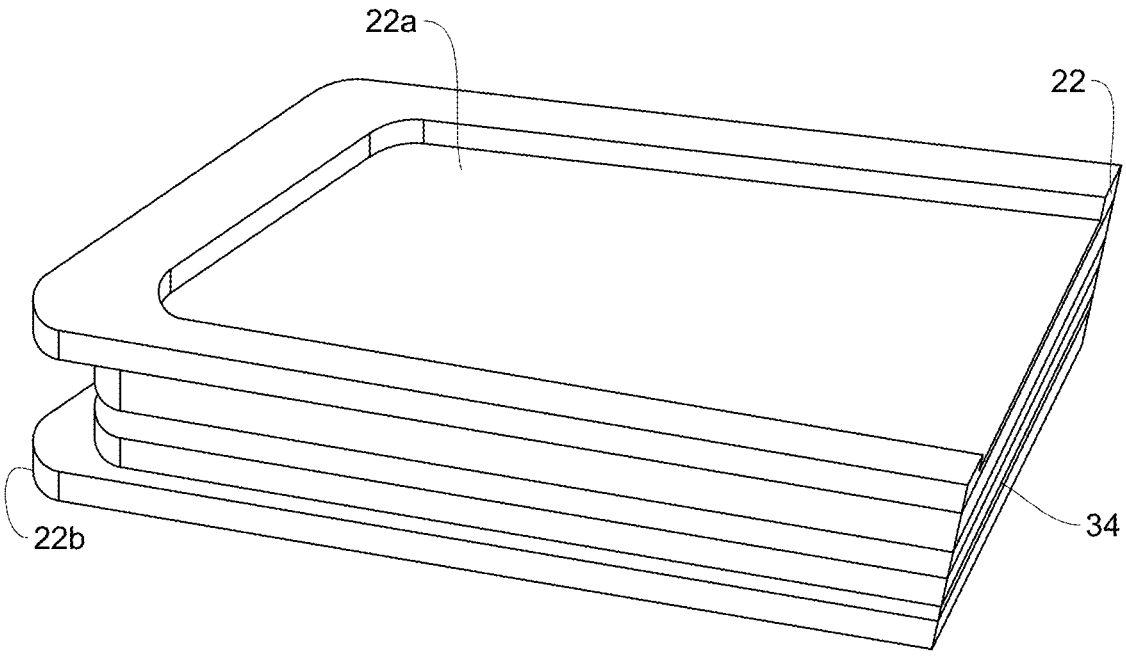
FIG. 4 is a side view of the lid in a folded configuration.

The fold line 34 enables the lid 22 to be positioned in an unfolded configuration, which is illustrated in FIG. 3, for attachment to the storage container 20 or a folded configuration, which is illustrated in FIG. 4, when it is desired to place the lid 22 in the lid storage region 30. If the lid 22 is fabricated from plastic, the plastic may be thinner proximate the fold line 34 to enable the lid 22 to be readily moved between the fold configuration and the unfolded configuration.

Figure 2A:
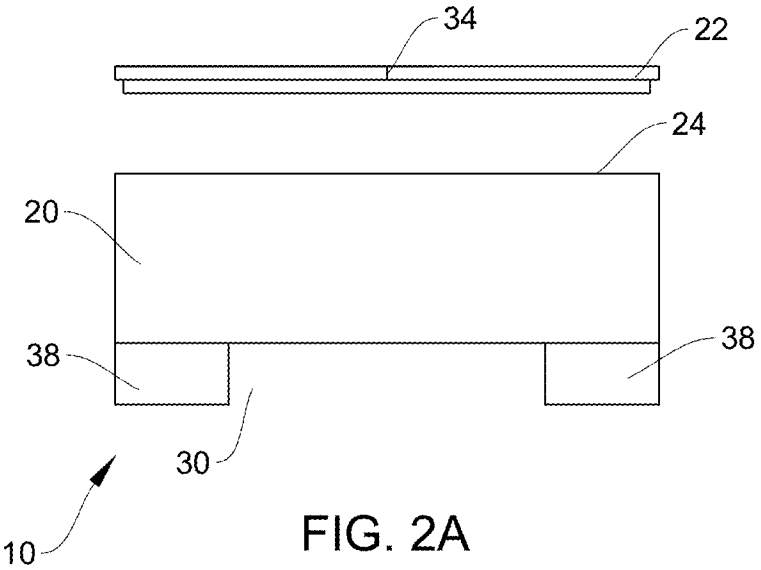
FIG. 2*a* is a front view of the lid in an unfolded position above the storage container.
Figure 2C:
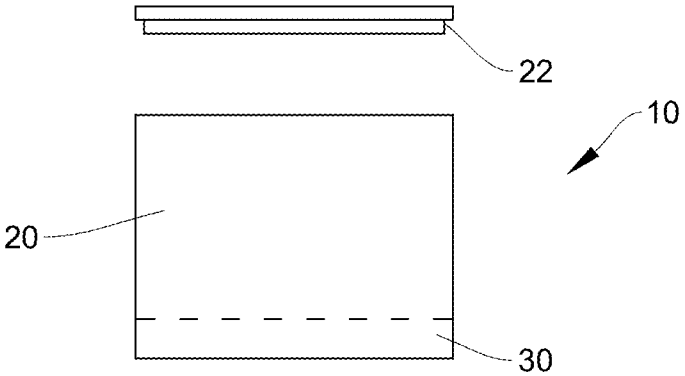
FIG. 2*c* is a side view of the lid in the unfolded position above the storage container.

FIGS. 2*a* and 2*c* illustrate the lid 22 positioned adjacent to the opening 24 of the storage container 20 such as when the lid 22 is being attached to the storage container 20. FIG. 2*b* illustrates the lid 22 positioned in the lid storage region 30.

In another embodiment, the lid storage region 30 is defined by adjoining or proximate downward side extensions on three sides of the storage container 20 of rectangular cross-section. This configuration may enhance the ability to retain the lid 22 in the lid storage region 30. A tab or flap extending downward from the bottom of the storage container 20 between opposite side extensions helps prevent the lid 22 from sliding off the flanges 36 and allows water to wash through the storage area for cleaning.

The storage container 20 and the lid 22 may be fabricated from a variety of materials using the concepts of the invention. An example of one preferred materials for fabricating the storage container 20 and the lid 22 is plastic.

Figure 5:
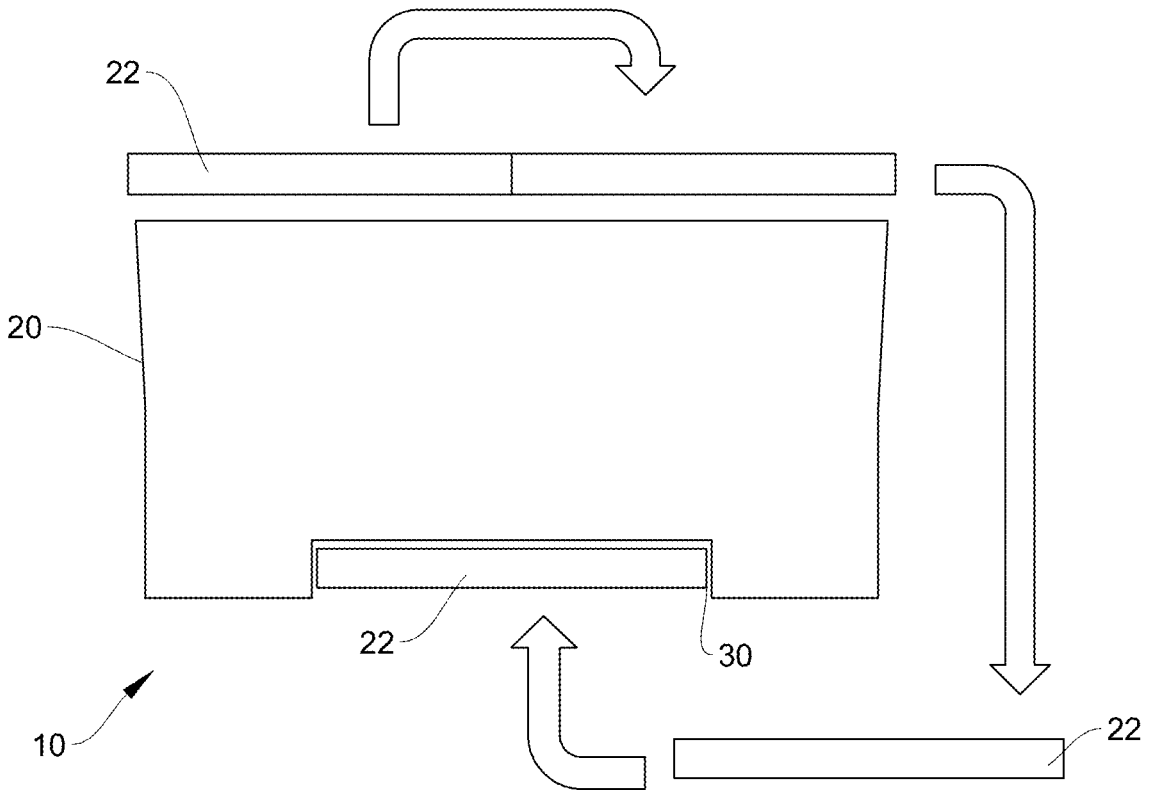
FIG. 5 is a side view illustrating the lid in different positions with respect to the storage container.
Figure 6:
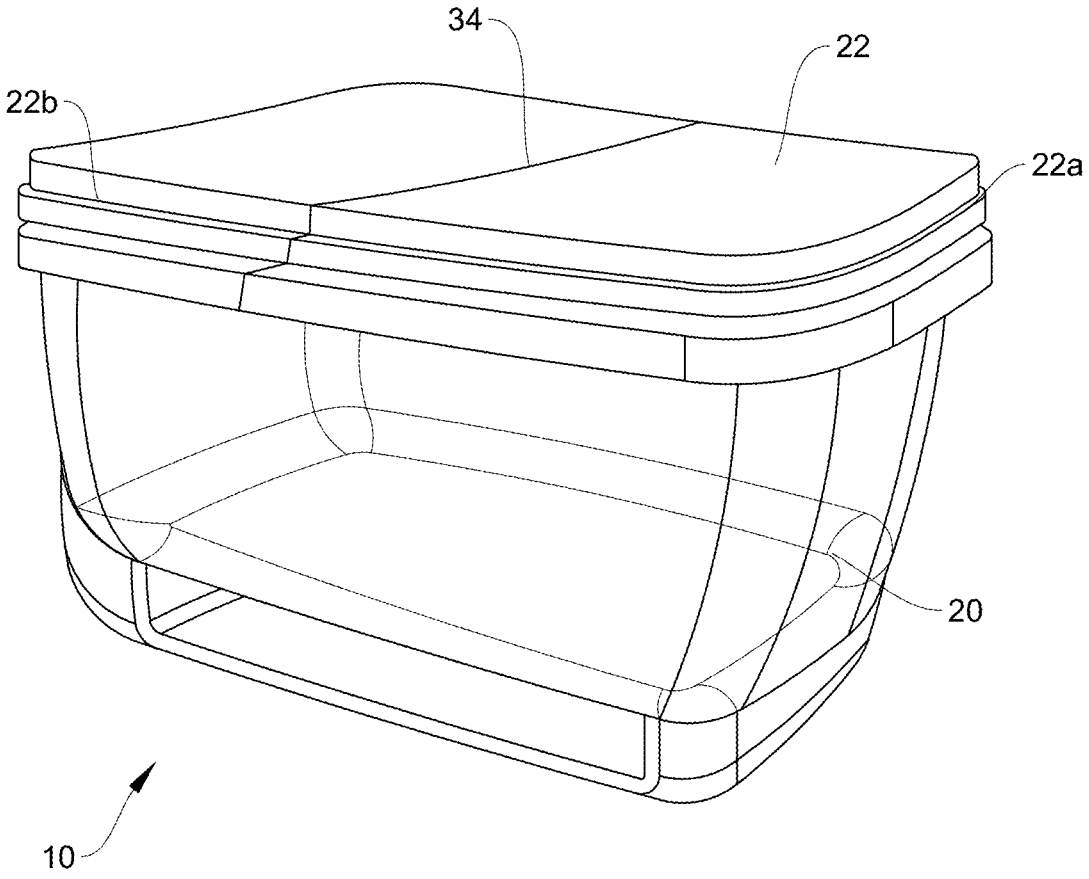
FIG. 6 is a side view of the storage container with the lid attached thereto.

In use, the different positions of the lid 22 with respect to the storage container 20 is illustrated in FIG. 5. The storage container system 10 may be initially positioned in a use configuration, which is illustrated in FIG. 6, where the lid 22 is attached to the storage container 20 such that the lid 22 and the storage container 20 substantially seal the interior 24 of the storage container 20.

Figure 7:
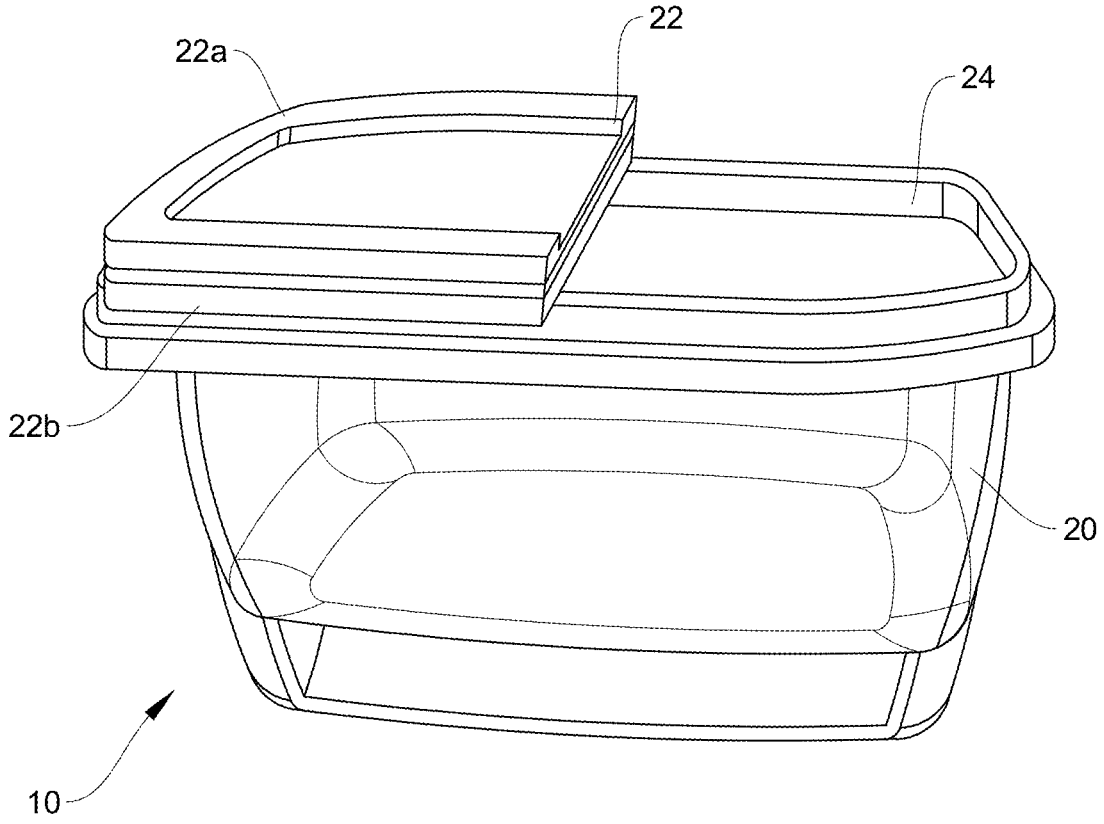
FIG. 7 is a side view of the storage container with the lid in a partially opened configuration.
Figure 8:
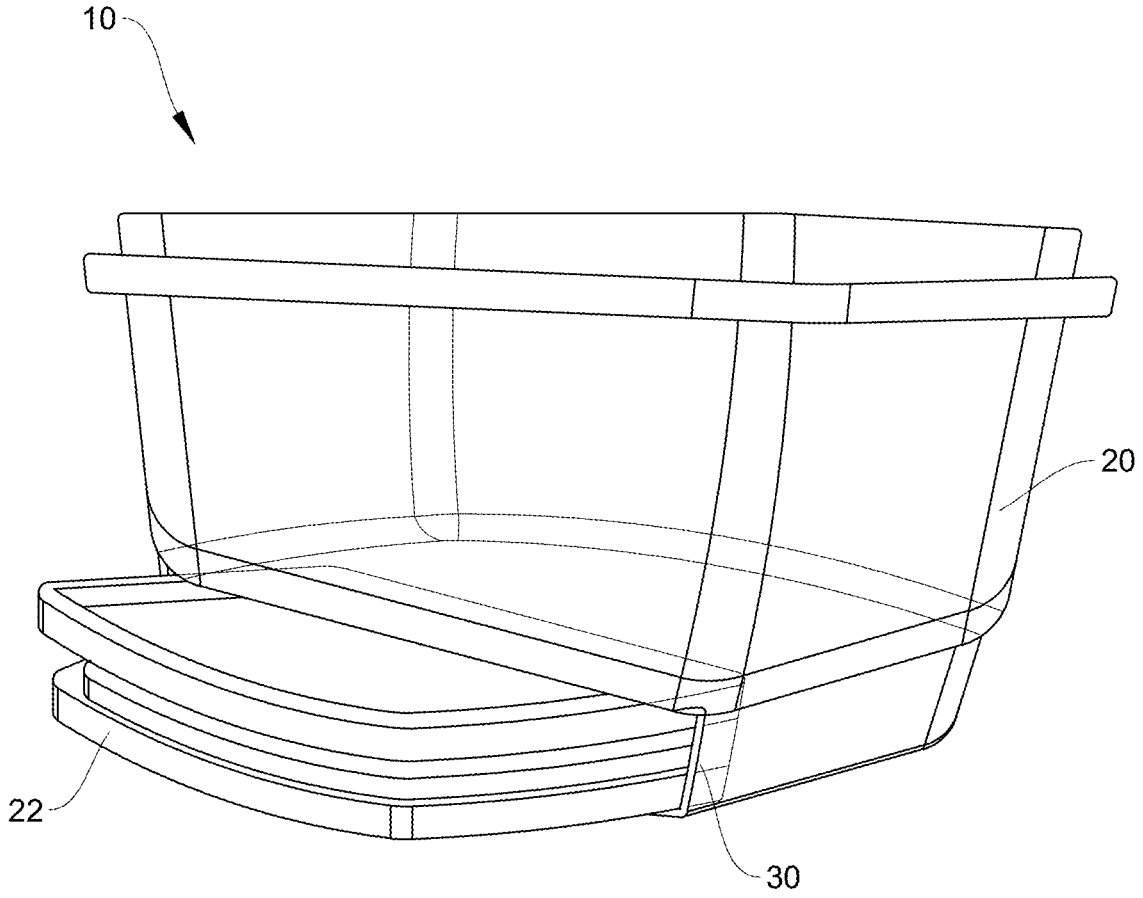
FIG. 8 is a perspective view of the storage container with the lid partially stored therein.

As an initial step in detaching the lid 22 from the storage container 20, the lid 22 is folded so that the first lid section 22*a* is adjacent to the second lid section, as illustrated in FIG. 7. Next, the lid 22 is separated from the storage container 20 and slid into the lid storage region 30 as illustrated in FIG. 8.

Figure 9:
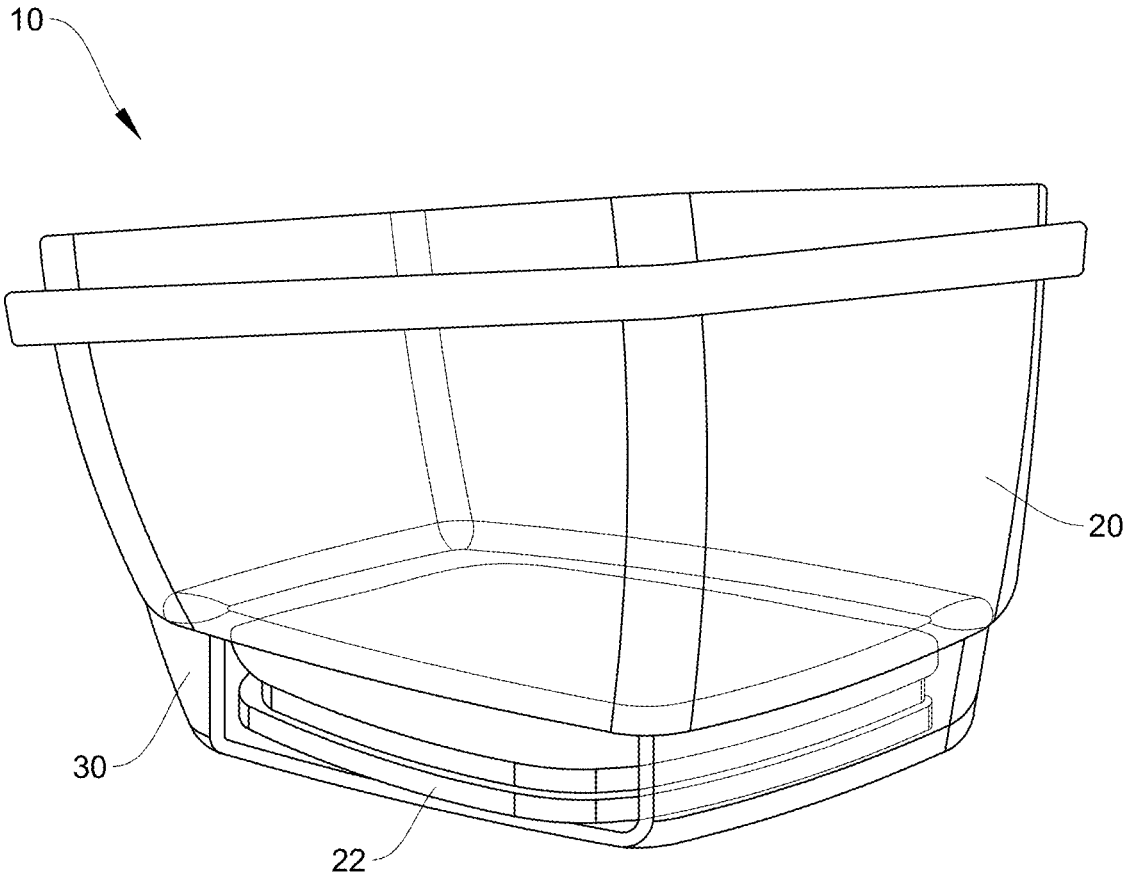
FIG. 9 is a perspective view of the storage container with the lid stored therein.
Figure 10:
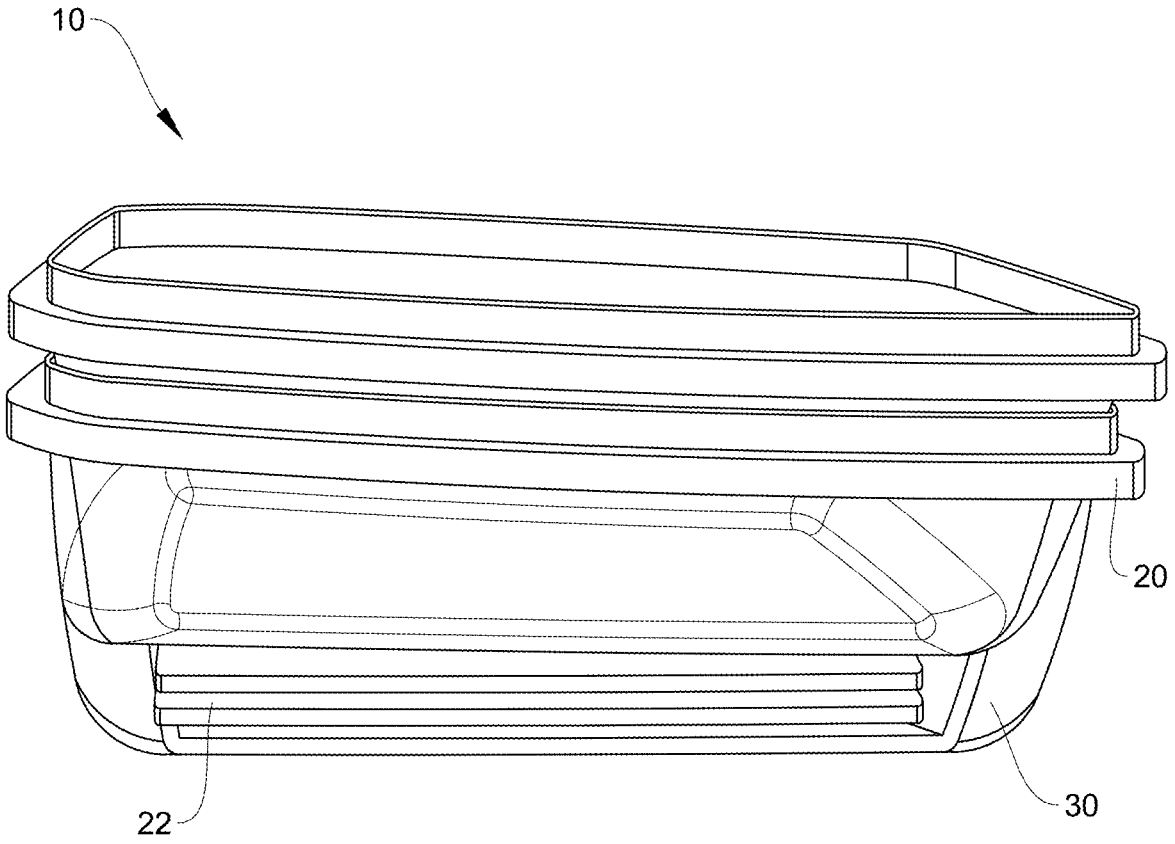
FIG. 10 is a side view of multiple storage containers in a stacked configuration for storage.

When the lid 22 is fully inserted into the lid storage region 30, as illustrated in FIG. 9, it is possible for multiple storage containers 20 to be stacked as illustrated in FIG. 10. This process not only retains the matching lids 22 and storage containers 20 together but also reduces the amount of space needed to store the multiple storage containers.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A stackable storage container system comprising:

a first lid that is positionable in a folded configuration and an unfolded configuration; and a first storage container having a generally rectangular bottom wall with an upper surface and a lower surface, side walls extending from a top surface of the bottom wall at an angle to define a storage container opening larger than the bottom wall, the side walls at the storage container opening including means for engaging the lid when in an unfolded configuration, and a first lid storage region located beneath the lower surface of the bottom wall, of dimension smaller than the bottom wall for receiving the first lid when in the folded configuration, wherein the first lid storage region is defined by the lower surface of the storage container bottom wall acting as a ceiling, three sides extending from the lower surface of the storage container bottom wall and a floor attached to the three sides to define an enclosed lid storage area with a single open side for receiving a folded lid;

wherein the first lid in the unfolded position is attachable to the storage container to substantially enclose the open top and wherein the first lid in the folded configuration is positionable entirely within the lid storage region;

a second lid that is positionable in a folded configuration and an unfolded configuration; and a second storage container having a generally rectangular bottom wall with an upper surface and a lower surface, side walls extending from the bottom wall at an angle to define a storage container opening larger than the bottom wall, the side walls at the storage container opening including means for engaging the second lid when in an unfolded configuration, and a second lid storage region located beneath the lower surface of the bottom wall of dimension smaller than the bottom wall for receiving the second lid when in the folded configuration, wherein the second lid storage region is defined by the lower surface of the storage container bottom wall acting as a ceiling, three sides extending from the lower surface of the storage container bottom wall and a floor attached to the three sides to define an enclosed lid storage area with a single open side for receiving a folded lid;

wherein the second lid in the unfolded position is attachable to the storage container to substantially enclose the open top and wherein the second lid in the folded configuration is positionable entirely within the second lid storage region;

wherein, when the first and second lids are folded and stored within their respective lid storage regions of their respective containers, the first storage container can be nested within the second storage container.

2. The storage container system of claim 1, wherein the first and second lids include a first lid section and a second lid section that are joined together along a fold line and wherein the first lid section has a shape and a size that is substantially the same as the shape and size of the second lid section.

3. The storage container system of claim 1, wherein the means for engaging the first and second lids when in an unfolded configuration is a lip formed at a top edge of the respective container side walls.

4. A stackable storage container comprising:

a lid that is positionable in a folded configuration and an unfolded configuration; and a storage container having a generally rectangular bottom wall with an upper surface and a lower surface, side walls extending from a top surface of the bottom wall at an angle to define a storage container opening larger than the bottom wall, the side walls at the storage container opening including means for engaging the lid when in an unfolded configuration, and a lid storage region located beneath the lower surface of the bottom wall of dimension smaller than the bottom wall for receiving the lid when in the folded configuration, wherein the lid storage region is defined by the lower surface of the storage container bottom wall acting as a ceiling, three sides extending from the lower surface of the storage container bottom wall and a floor attached to the three sides to define an enclosed lid storage area with a single open side for receiving a folded lid;

wherein the lid in the unfolded position is attachable to the storage container to substantially enclose the open top and wherein the lid in the folded configuration is positionable entirely within the lid storage region.

* * * * *